US007815080B2

(12) United States Patent
Zuckerman

(10) Patent No.: US 7,815,080 B2
(45) Date of Patent: Oct. 19, 2010

(54) RELEASABLY LOCKABLE PINCH GRIP HANGER

(75) Inventor: Andrew Zuckerman, New York, NY (US)

(73) Assignee: Capco Wai Shing LLC, New York, NY (US)

( * ) Notice: Subject to any disclaimer, the term of this patent is extended or adjusted under 35 U.S.C. 154(b) by 50 days.

(21) Appl. No.: 11/823,434

(22) Filed: Jun. 26, 2007

(65) Prior Publication Data

US 2009/0001108 A1 Jan. 1, 2009

(51) Int. Cl.
*A41D 27/22* (2006.01)

(52) U.S. Cl. ..... 223/96; 223/90; 223/93; 223/95

(58) Field of Classification Search ..... 223/85, 223/93, 96, 88, 90, 91, 95, DIG. 2; D6/328
See application file for complete search history.

(56) References Cited

U.S. PATENT DOCUMENTS

| | | | | | |
|---|---|---|---|---|---|
| 2,048,899 | A | | 7/1936 | Tromp | |
| 2,162,796 | A | | 6/1939 | Beckman | |
| 2,872,089 | A | | 2/1959 | Shrom | |
| 3,487,984 | A | | 1/1970 | Loscalzo et al. | |
| 3,698,043 | A | * | 10/1972 | Batts | 223/91 |
| 3,698,607 | A | * | 10/1972 | Batts | 223/96 |
| 3,745,616 | A | * | 7/1973 | Batts | 223/96 |
| 3,950,829 | A | * | 4/1976 | Cohen | 223/96 |
| 3,973,705 | A | | 8/1976 | Erthein | |
| 4,023,721 | A | * | 5/1977 | Erthein | 223/96 |
| 4,231,500 | A | * | 11/1980 | Mainetti | 223/96 |
| 4,807,334 | A | * | 2/1989 | Blanchard | 223/91 |
| 5,022,126 | A | | 6/1991 | Davis | |
| 5,027,480 | A | * | 7/1991 | Hogarth | 24/543 |
| 5,350,092 | A | * | 9/1994 | Hollis | 223/96 |
| 5,539,963 | A | * | 7/1996 | Fujiwara et al. | 24/536 |
| 5,657,518 | A | | 8/1997 | Hunt | |
| 6,021,933 | A | | 2/2000 | Zuckerman | |
| 6,116,482 | A | * | 9/2000 | Heiber | 223/96 |
| 6,202,906 | B1 | | 3/2001 | Zuckerman | |
| 6,382,479 | B2 | | 5/2002 | Zuckerman | |
| 6,622,897 | B2 | | 9/2003 | Bokmiller et al. | |
| 2002/0158091 | A1 | * | 10/2002 | Matkovich | 223/93 |

* cited by examiner

*Primary Examiner*—Gary L Welch
*Assistant Examiner*—Nathan E Durham
(74) *Attorney, Agent, or Firm*—Amster, Rothstein & Ebenstein, LLP

(57) ABSTRACT

A hanger includes at least one pinch-grip attached to the hanger for receiving an article for hanging. The pinch-grip includes first and second components extending substantially vertically from the hanger and cooperatively defining a pivot axis, each of the components including an upper end extending above the pivot axis and a lower end extending below the pivot axis. A spring force biases the lower ends together to a closed position and permits separation of the lower ends to an open position by pivotal movement of at least one of the upper ends towards the other upper end. A releasable lock can be activated to hold the lower ends of the components in the open position.

37 Claims, 13 Drawing Sheets

RELEASABLY LOCKABLE PINCH GRIP HANGER

BACKGROUND OF THE INVENTION

1. Field

The present invention relates to a garment hanger, and more particularly, to a garment hanger including a pinch-grip that is releasably lockable in the open position.

2. Description of Related Art

Pinch-grip garment hangers are well known in the art. Pinch-grip hangers are used by retail stores and apparel manufacturers to suspend garments from the pinch-grips, such as a pair of pants, a skirt, or the like. A conventional pinch-grip garment hanger includes a hanger body and a hook for securing the hanger to a support. The hanger body may include a transverse portion defining a pair of free outer ends, for example, to support the shoulders of a jacket. At least one pinch-grip is attached to the hanger for securing a garment to the hanger.

Each pinch-grip includes a pair of vertically-extending components, means for pivotally securing the components together, and means for spring biasing the lower ends of the components together in the "closed position" (i.e. gripping orientation). To insert or remove an article from the hanger, the upper ends of the components are pressed together so that the components pivot relative to each other and the lower ends are separated into an "open position" (i.e., garment insertion orientation).

Conventional pinch-grips require a user to squeeze open the components of the pinch-grip with enough force to overcome the spring biasing force, and hold the pinch-grip open until they have inserted a garment between the components. With such conventional pinch-grip hangers, the user is required to use one hand to open the pinch-grip and hold the pinch-grip in the open position, and one hand to insert one end of the garment, all while attempting to hold the hanger steady. This makes it time consuming and difficult to center and neatly hang garments on the hanger.

Employees of retail stores and apparel manufacturers may be required to open pinch-grips hundreds or thousands of times a day. The inefficient operation of conventional pinch-grips may cause a loss in productivity and sloppy garment hanging. Further, the repeated opening and holding open of the pinch-grips may cause the employees fingers' to become stressed and tired, which may potentially lead to chronic injuries, such as carpal tunnel syndrome or arthritis.

SUMMARY OF THE INVENTION

According to a first embodiment, a hanger includes at least one pinch-grip attached to the hanger for receiving an article for hanging. The pinch-grip includes first and second components extending substantially vertically from the hanger and cooperatively defining a pivot axis, each of the components including an upper end extending above the pivot axis and a lower end extending below the pivot axis. A spring force biases the lower ends together to a closed position and permits separation of the lower ends to an open position by pivotal movement of at least one of the upper ends towards the other upper end. The pinch-grip also includes a releasable lock which can be activated to hold the lower ends of the components in the open position.

According to another embodiment, a hanger includes at least one pinch-grip attached to the hanger for receiving an article for hanging. The pinch-grip includes first and second components extending substantially vertically from the hanger and cooperatively defining a pivot axis, each of the components including an upper end extending above the pivot axis and a lower end extending below the pivot axis. A spring force biases the lower ends together to a closed position and permits separation of the lower ends to an open position by pivotal movement of at least one of the upper ends towards the other upper end. The pinch-grip also includes a latch extending from the first component toward the second component that releasably locks the upper ends together when the lower ends are pivotally moved to the open position.

According to another embodiment, a hanger includes at least one pinch-grip attached to the hanger for receiving an article for hanging. The pinch-grip includes first and second components extending substantially vertically from the hanger and cooperatively defining a pivot axis, each of the components including an upper end extending above the pivot axis and a lower end extending below the pivot axis. A spring force biases the lower ends together to a closed position and permits separation of the lower ends to an open position by pivotal movement of at least one of the upper ends towards the other upper end. The pinch-grip also includes a projection extending from the first component toward the second component. When the lower ends are pivotally moved to the open position, the projection releasably locks the upper ends together such that the lower ends are held in the open position.

According to another embodiment, a hanger includes at least one pinch-grip attached to the hanger for receiving an article for hanging. The pinch-grip includes first and second components extending substantially vertically from the hanger and cooperatively defining a pivot axis, each of the components including an upper end extending above the pivot axis and a lower end extending below the pivot axis. A spring force biases the lower ends together to a closed position and permits separation of the lower ends to an open position by pivotal movement of at least one of the upper ends towards the other upper end. The pinch-grip also includes a releasable lock that is automatically activated upon movement of the lower ends to the open position to hold the lower ends of the components in the open position These and other features of this invention are described in, or are apparent from, the following detailed description of various exemplary embodiments of this invention.

BRIEF DESCRIPTION OF THE DRAWINGS

Example embodiments of this invention will be described with reference to the accompanying figures.

DETAILED DESCRIPTION OF THE EXAMPLE EMBODIMENTS

Figure 1:
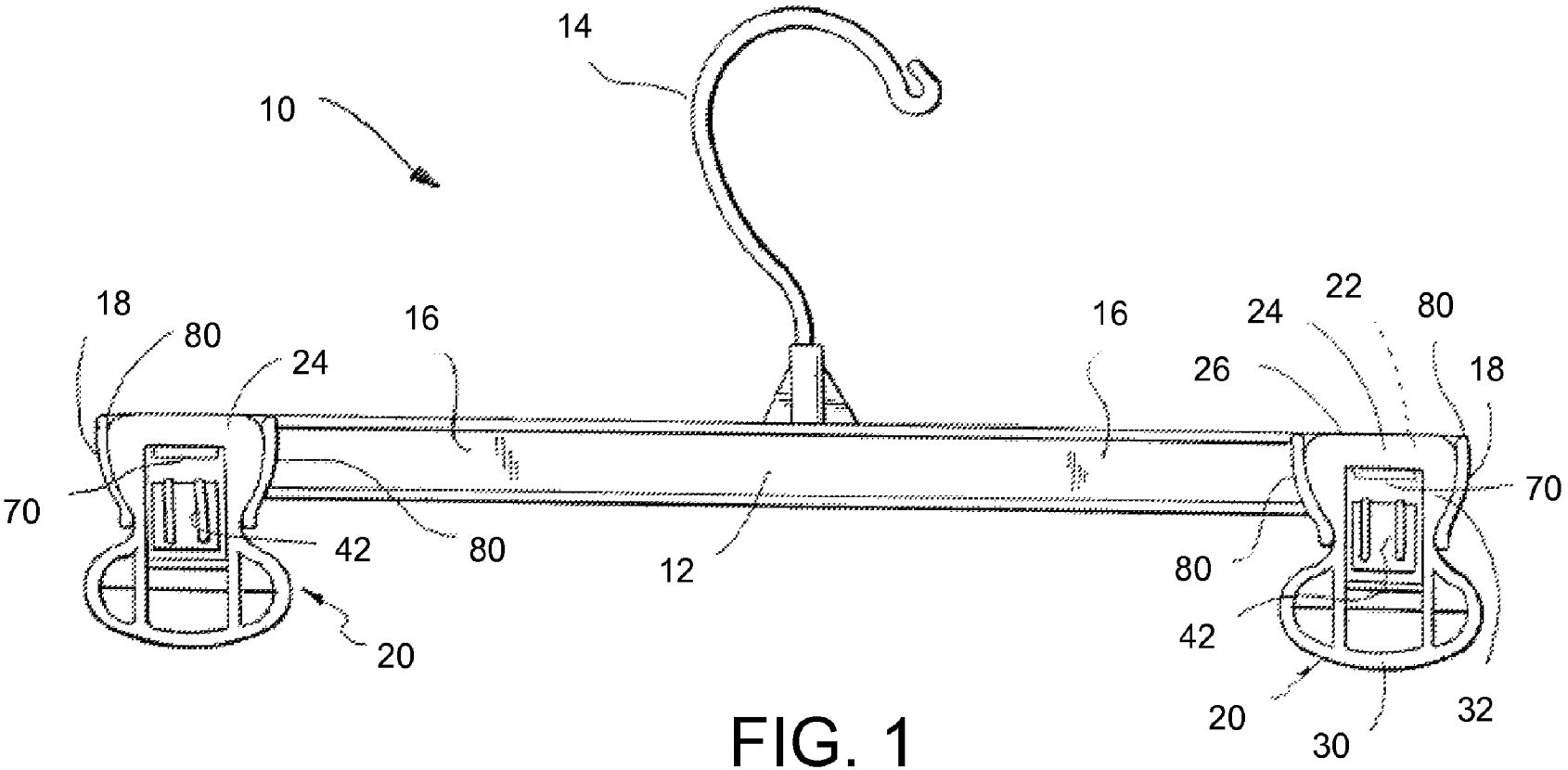
FIG. 1 is a frontal view of a pinch-grip hanger according to one embodiment of the invention.

Referring to FIG. 1, a secure pinch-grip hanger 10 comprises a hanger body 12 and an attachment portion 14 for securing the hanger body 12 to a support (not shown). The hanger body 12 includes a transverse portion 16 defining a pair of free outer ends 18. For example, the hanger body 12 including the transverse portion 16 may be formed of injection molded plastic, wood, metal, etc.

As illustrated in FIG. 1, the attachment portion 14 is shown as a hook, however other embodiments may utilize other means for attaching the hanger body 12 to a support, for example, a transversely-extending elevated rod (not shown). The attachment portion 14 may also be formed of injection molded plastic or may be formed of metal and connected to the hanger body 12.

The hanger 10 includes at least one pinch-grip 20. In the embodiment illustrated in FIG. 1, one pinch-grip 20 is disposed adjacent to each free end 18 of the transverse portion 16 of the hanger body 12. In other embodiments, a single pinch-grip 20 may be disposed centrally between the free ends 18, or three or more pinch-grips 20 may be disposed at intervals between the free ends 18. Further, in other embodiments, the hanger 10 may not include hanger body 12 defining a transverse portion 16, but instead a single pinch-grip 20 may be attached directly to the attachment portion 14 (e.g., a sock hanger). Further still, in other embodiments, at least one pinch-grip 20 may be attached to a rod (not shown) that is disposed between the free ends 18 of the transverse portion 16 of the hanger body 12 (e.g., a suit hanger).

Figure 2:
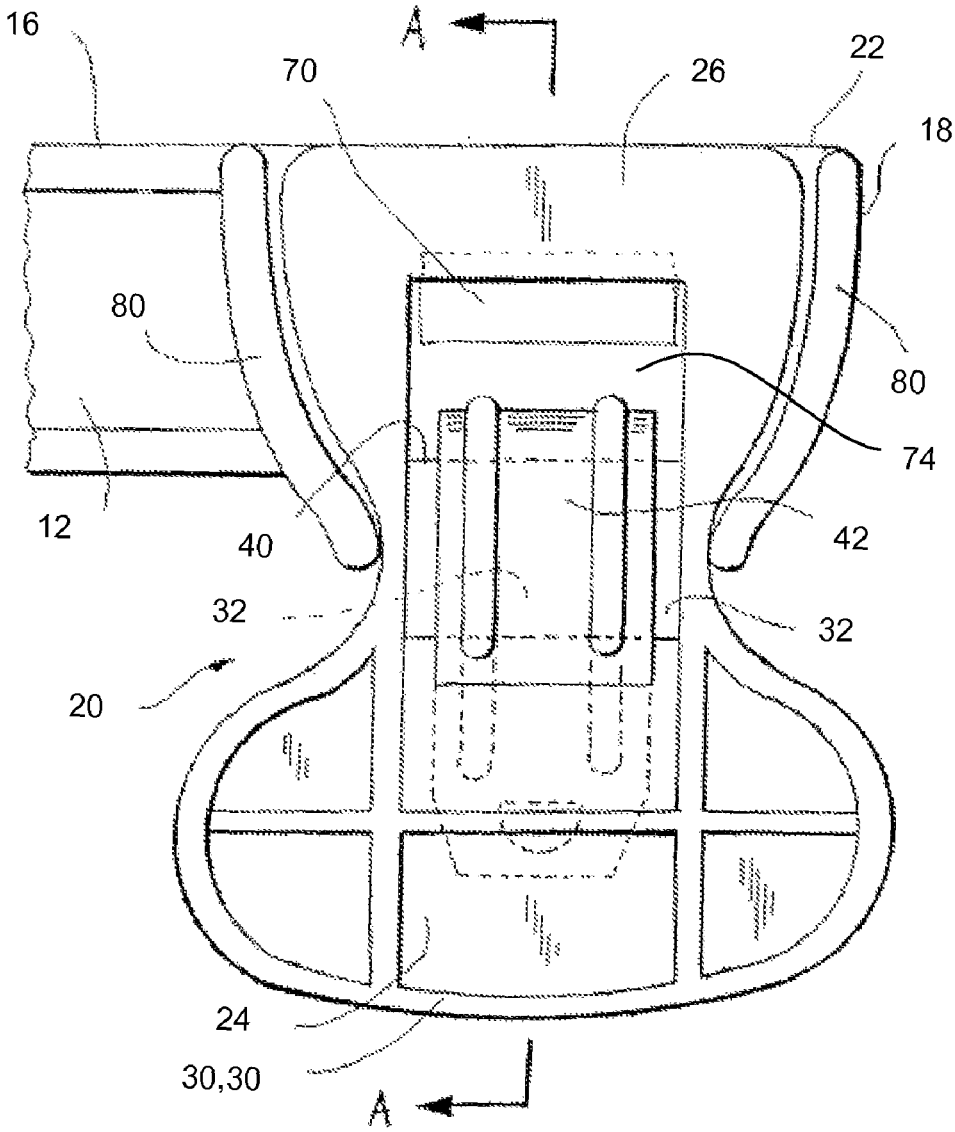
FIG. 2 is a frontal plan view of a pinch-grip according to one embodiment of the invention.
Figure 3:
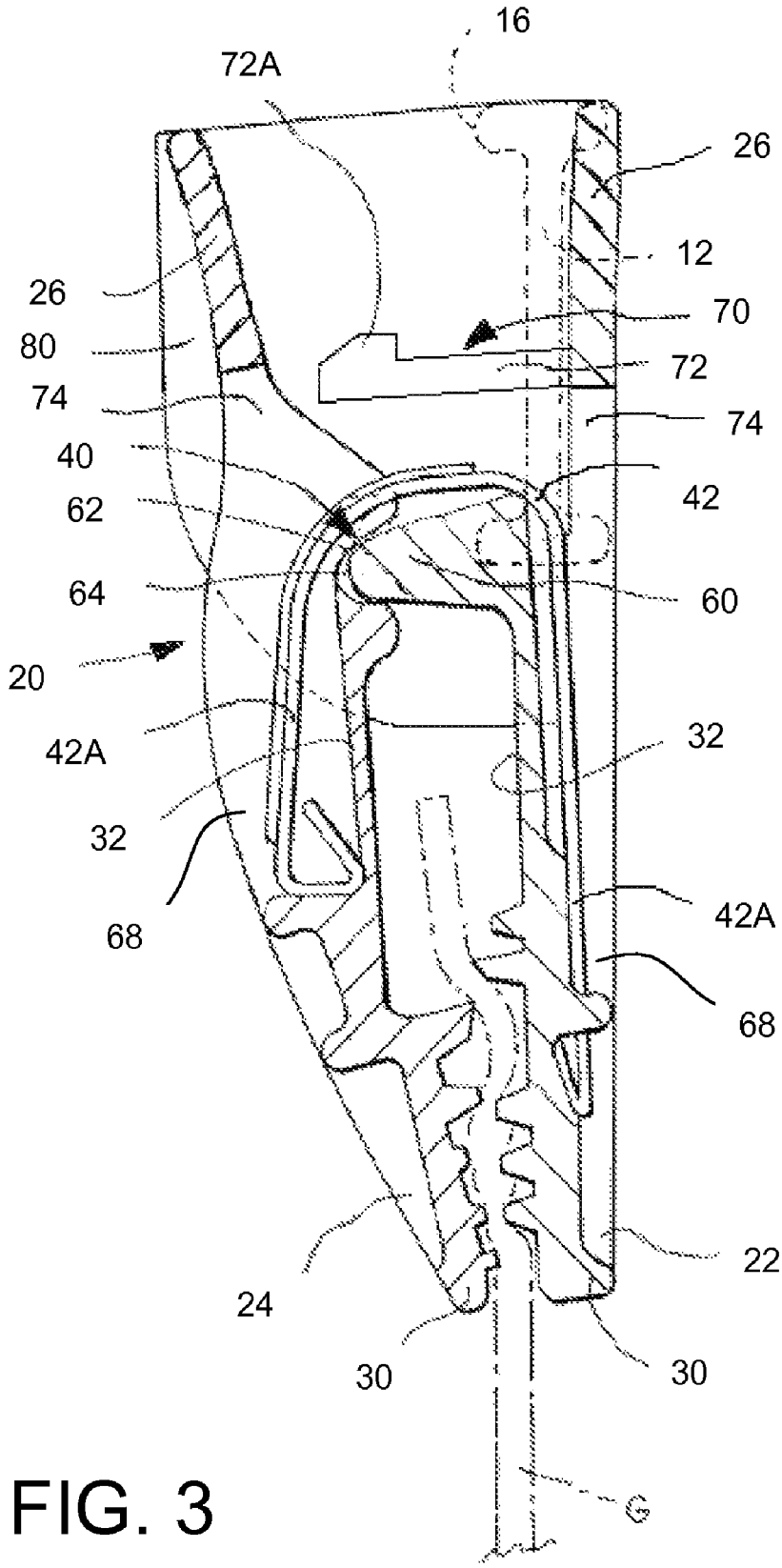
FIG. 3 is a cross sectional view of the pinch-grip in the closed position taken along the lines A-A of FIG. 2.
Figure 4:
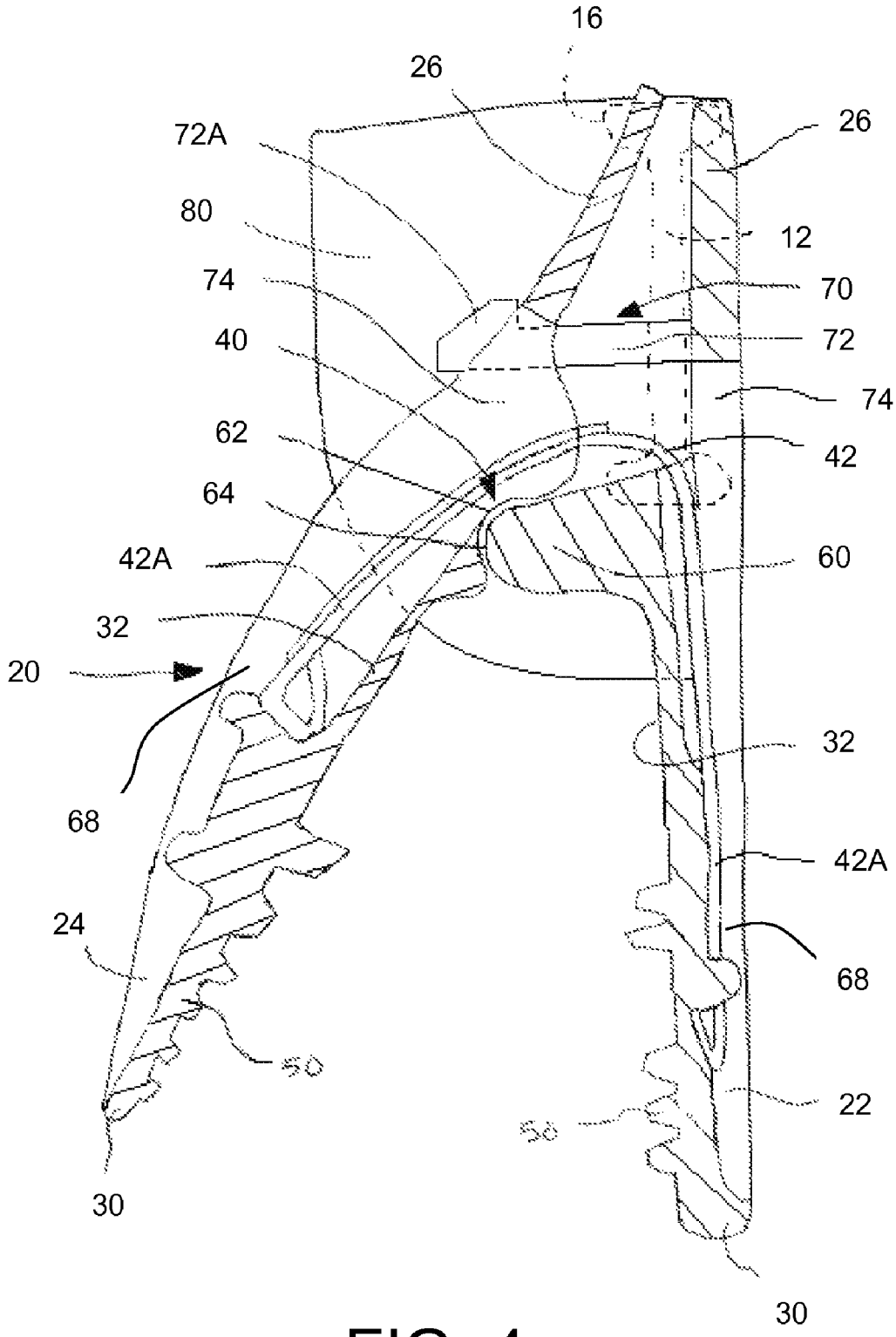
FIG. 4 is a cross sectional view of the pinch-grip in the open position taken along the lines A-A of FIG. 2.

Referring to FIGS. 2-4, each pinch-grip 20 includes first and second components 22, 24 extending substantially vertically from the hanger body and cooperatively defining a pivot axis. Each of the vertically-extending components 22, 24 defines an upper end 26 that extends above the pivot axis, a lower end 30 that extends below the pivot axis, and a body portion 32 between the ends 26, 30. For example, if the first and second components 22, 24 are formed of plastic, each component 22, 24 may be separately injection molded or the two components 22, 24 may be injection molded with a connecting living hinge (not shown). The first and second components 22, 24 may also be formed of metal or any other suitable material.

Figure 7:
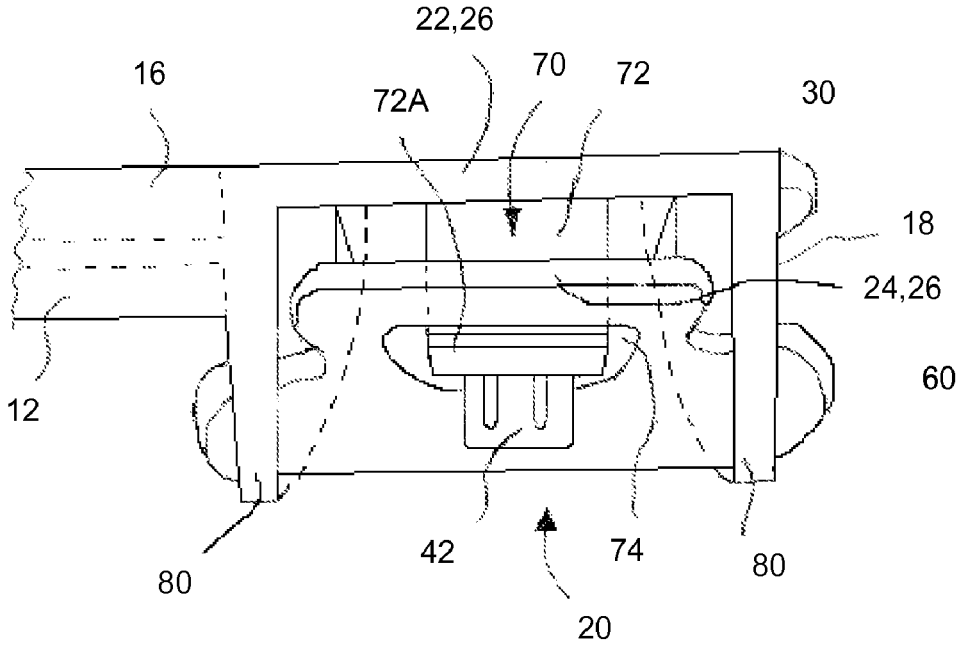
FIG. 7 is a top view of the pinch-grip in the open position.
Figure 8:
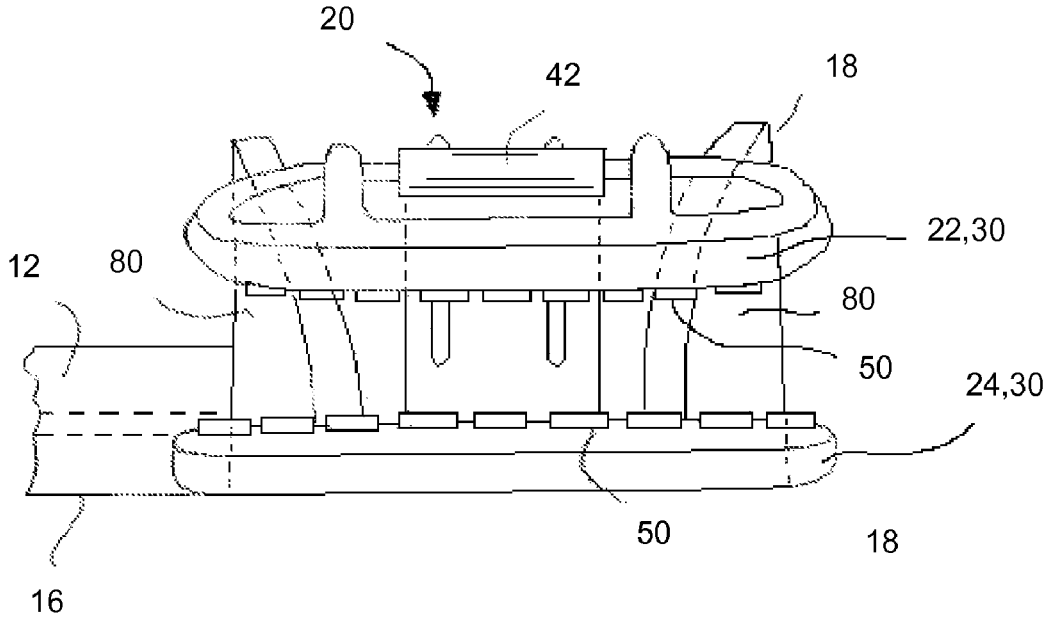
FIG. 8 is a bottom view of the pinch-grip in the open position.

A pivot connector 40 is provided for pivotably juxtaposing the first and second components 22, 24 together at the pivot axis. When the upper ends 26 of the components 22, 24 are pivoted towards each other, the lower ends 30 are separated from each other toward an "open position" (i.e., garment insertion orientation, as illustrated in FIGS. 4, 7, and 8) to enable insertion or removal of an article or garment. For example, the first and second components 22, 24 may be secured together and pivotably juxtaposed by the pivot connector 40 at the body portions 32.

As illustrated in FIGS. 2-4, the first component 22 is stationary relative to the hanger body 12 and the second component 24 is pivotable. In other embodiments, the second component 24 may be stationary relative to the hanger body 12 and the first component 22 may be pivotable. In other embodiments, both the first and second components 22, 24 may be pivotable relative to the hanger body 12. Further, in other embodiments, the entire pinch-grip 20 may be rotatable about an axis parallel to the transverse portion 16 of the hanger body 12.

The pivot connector 40 may be cooperatively defined between the first and second components 22, 24. To define the pivot connector 40, the second component 24 includes at least one projection 62 running lengthwise along at least a portion of the inner surface of second component 24. A receiving socket 64 is defined in the projection 62. The projection 62 including the receiving socket 64 may be formed integrally with the second component 24. The first component 22 includes a horizontal pivot projection 60 disposed intermediate the upper and lower ends 26, 30. The receiving socket 64 receives the pivot projection 60, thus maintaining the first and second components 22, 24 in a pivotable relationship.

However, it will be appreciated by those skilled in the art that a variety of conventional means may be used instead to pivotably secure together the body portions 32 of the components 22, 24. For example, the pivot connector 40 may be a ball-and-socket joint, and if the first and second components 22, 24 are formed of plastic, the pivot connector 40 may be a living hinge (not shown).

Figure 5:
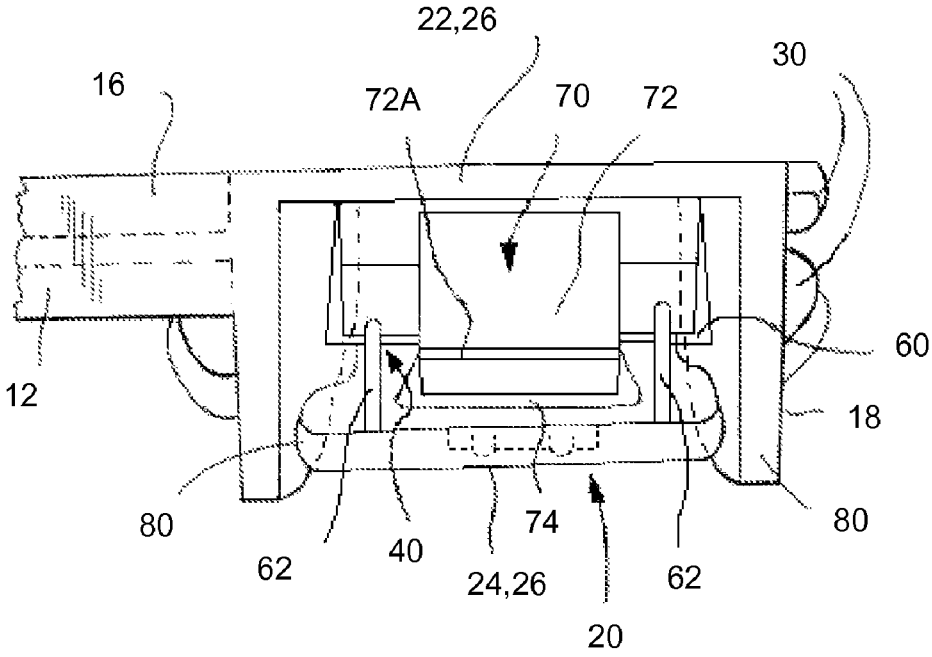
FIG. 5 is a top view of the pinch-grip in the closed position.
Figure 6:
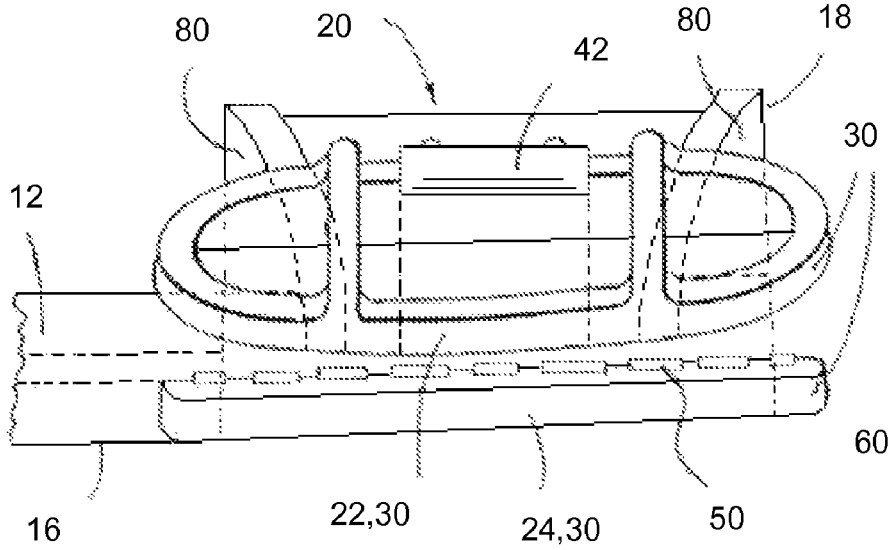
FIG. 6 is a bottom view of the pinch-grip in the closed position.

A spring force 42 is provided for biasing the lower ends 30 of the first and second components 22, 24 together to define a "closed position" (i.e., gripping orientation, as illustrated in FIGS. 3, 5, and 6) wherein the upper ends 26 of the first and second components 22, 24 are spaced apart. In this orientation, the lower ends 30 are configured and dimensioned to cooperatively receive and maintain an article therebetween, such as a garment G (shown in phantom line in FIG. 3). In the absence of any garment between the lower ends 30 of the two components 22, 24, the spring force 42 biases the lower ends 30 together to define an "abutting" orientation wherein the lower ends 30 come in contact with each other.

Gripping pads 50 are provided on a portion of the lower end 30 of each of the first and second components 22, 24 so that the lower ends 30 may more securely grasp an article therebetween. The gripping pads 50 may be formed integrally with the components 22, 24, or may be formed separately from the components 22, 24 and inserted therein. The gripping pads 50 may have a smooth surface, or may have ridged portions, teeth, etc. which may provide an enhanced gripping surface.

In operation, the spring force 42 biases the components 22, 24 to the closed position to enable gripping of an article portion by the gripping pads 50 or to the abutting orientation if no article portion is disposed between the gripping pads 50. Conversely, when the upper end 26 of the second component 24 is forced toward the upper end 26 of the first component 22, against the influence of the spring force 42, the component lower ends 30 (and the lower ends of the spring legs 42A) separate and the components 22, 24 move to the open position to enable insertion of an article portion between the gripping pads 50.

As illustrated in FIGS. 1-8, the spring force 42 is exerted on the lower ends 30 of the first and second components 22, 24 by an inverted "U"-shaped spring. The "U"-shaped spring 42 includes a pair of extended spring legs 42A which extend through apertures 74 formed in each of the first and second components 22, 24. The spring legs 42*a* are received in recesses or grooves 68 formed on the outer surface of each of the first and second components 22, 24. The lower end of each recess or groove 68 terminates adjacent the lower ends 30 of the component 22, 24, and the upper end of each recess or groove 68 terminates adjacent the apertures 74. The recess or groove 68 of each component 22, 24 may be turned inwardly to define a beveled or partially covered recess or groove 68 into which a spring leg 42A may enter from above, which then locks the spring leg 42A thereto for movement horizontally as a unit. Alternatively, each spring leg 42A may extend down the recess or groove 68 and then inwardly to the inner surface of the component 22, 24 and then downwardly again along the body portion 32 (and possibly the lower end 30), which then locks the spring leg 42A thereto for movement horizontally as a unit.

It will be appreciated by those skilled in the art that a variety of springs or other biasing mechanisms may be used to supply the spring force 42 to bias the lower ends 30 together and that various different structures of the components 22, 24 may interact therewith. For example, a torsion spring may be disposed around the pivot axle 60 having arms providing the biasing spring force 42 against the upper ends 26 of the first and second components 22, 24, respectively, or a coil compression spring may be disposed between the upper ends 26 of the first and second components 22, 24 to provide the biasing spring force 42.

The spring force 42 may be supplied separate and distinct from the pivot connector 40, as illustrated. However, according to other embodiments, the pivot connector 40 may itself supply the spring force 42, for example, a strongly resilient living hinge (not shown).

To enhance the security of the pinch-grip 20, protective projections 80 may be provided on one or both sides of the upper end 26 of the first component 22 (typically the stationary component) to define a raised pocket, collar or recess facing the upper end 26 of the second component 24. The projections 80 may be formed integrally with the first component 22. The upper end 26 of the second component 24 (typically the pivotable component) is configured and dimensioned to define a head that is totally or partially received within the recess. The projections 80 may shield the received head from pressures exerted by closely adjacent hangers or articles thereon, and thus inhibit accidental movement of the pinch-grip 20 toward the open position.

A releasable lock 70 is provided to lock the upper ends 26 of the first and second components 22, 24 together such that the lower ends 30 are held in the open position. The lock 70 may be automatically activated upon moving the upper ends 26 together, thus the user can operate the pinch-grip 20 to lock the lower ends in the open position with the use of only one hand. The lock 70 is also releasable so that the pinch-grip 20 can be reused over and over again.

In one embodiment as illustrated in FIGS. 1-8, the lock 70 includes a projection 72 extending substantially transverse from the upper end 26 of the first component 22 (typically the stationary component). The projection 72 is formed in a generally rectangular shape, but the projection may also be formed in any other suitable shape. The projection 72 includes at least one raised portion 72A that protrudes from the upper surface (alternatively, the lower surface or a side surface) of the projection 72 adjacent the free end.

The second component 24 (typically the pivotable component) may include an aperture 74 formed therethrough. When a force is exerted against the upper ends 26 of the components 22, 24 to overcome the biasing spring force 42, the lower ends 30 are moved toward the open position and the projection 72 is extended through the aperture in the second component 24. The outward facing edge of the raised portion 72A that comes in contact with the second component 24 may be beveled to guide the projection 72 to bend so that it passes smoothly past the second component 24.

Once the entire raised portion 72A extends beyond the outer surface of the second component 24, the projection 72 returns to its unbent extended position and the force exerted against the upper ends 26 is removed. As the biasing spring force 42 begins to move the lower ends 30 back toward the closed position, the inward facing side surface of the raised portion 72A engages against the outer surface of the second component 24. Thus, the upper ends 26 are locked together to prevent relative rotation between the components 22, 24, thereby holding the lower ends 30 in the open position to allow insertion of a garment.

Figure 9:
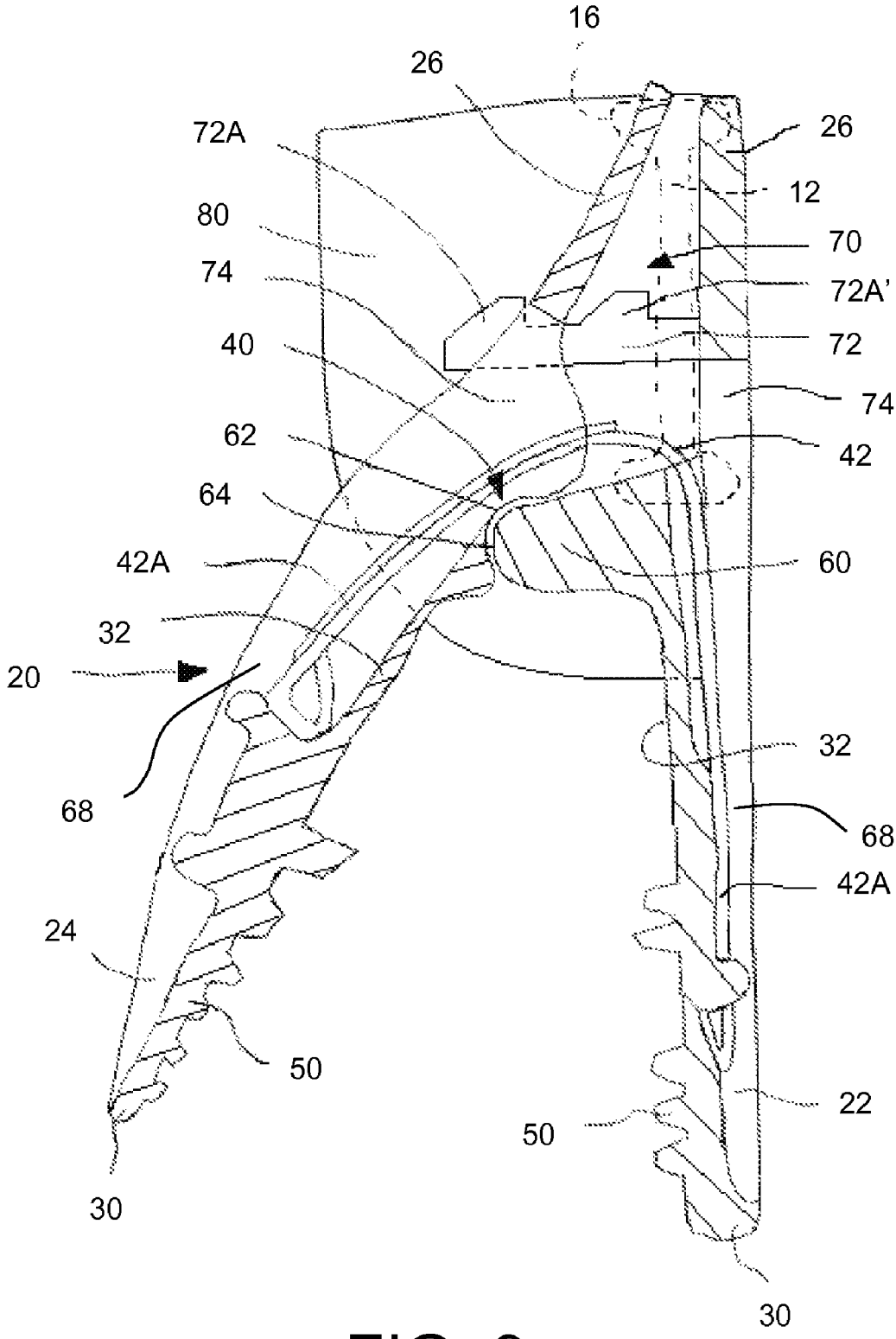
FIG. 9 is a cross sectional view of the pinch-grip in an intermediate open position according to one embodiment of the invention.

The projection 72 may include one or more additional raised portions 72A' (as illustrated in FIG. 9) so that the lower ends may be held in an intermediate open position or a fully open position. For example, the lock 70 may act as a ratchet.

Figure 11:
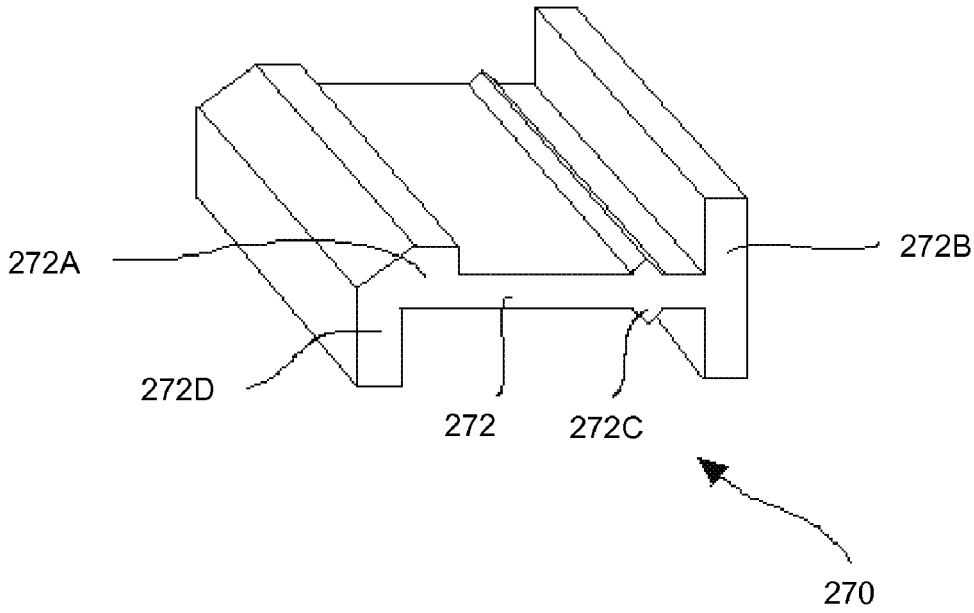
FIG. 11 is an isometric view of a latch insert according to one embodiment of the invention.

To release the lock 70, the inward facing side surface of the raised portion 72A is disengaged from the outer surface of the second component 24. The biasing spring force 42 pushes the lower ends 30 of the components 22, 24 back toward the closed position. The lock 70 may be disengaged by pushing the lower ends 30 together or by pushing down on the projection 72. The projection 72 may also include a release portion 272D (as shown in FIG. 11) that extends from a surface of the projection 72 opposite the raised portion 72A and adjacent the free end to provide a larger grippable area to assist in disengaging the lock 70.

The outer surface of the second component 24 may include a recess or groove (not shown) to receive the raised portion 72A of the projection 72. The recess or groove may provide a surface more closely matching the contour of the inward facing side surface of the raised portion 72A so that the lock 70 is more securely held in place. Alternatively, the recess or groove may be angled such that the raised portion 72A may de disengaged from the second component 24 more easily.

The projection 72 may be formed of the same plastic as the remainder of the first component 22 and may be integrally formed therewith. The projection 72 may include appropriate ribbing or structure to insure that a horizontal rearward force exerted on the free end of the projection 72 does not seriously diminish its length or cause undue bending same. The projection 72 may be resiliently bendable so that minor vertical displacement of the projection 72 under the influence of the aperture 74 and the aforementioned clasping force is possible. The projection 72 may also be slightly curved so as to provide a radius of curvature generally similar to the radius of curvature of the path of motion of the aperture 74.

Figure 10:
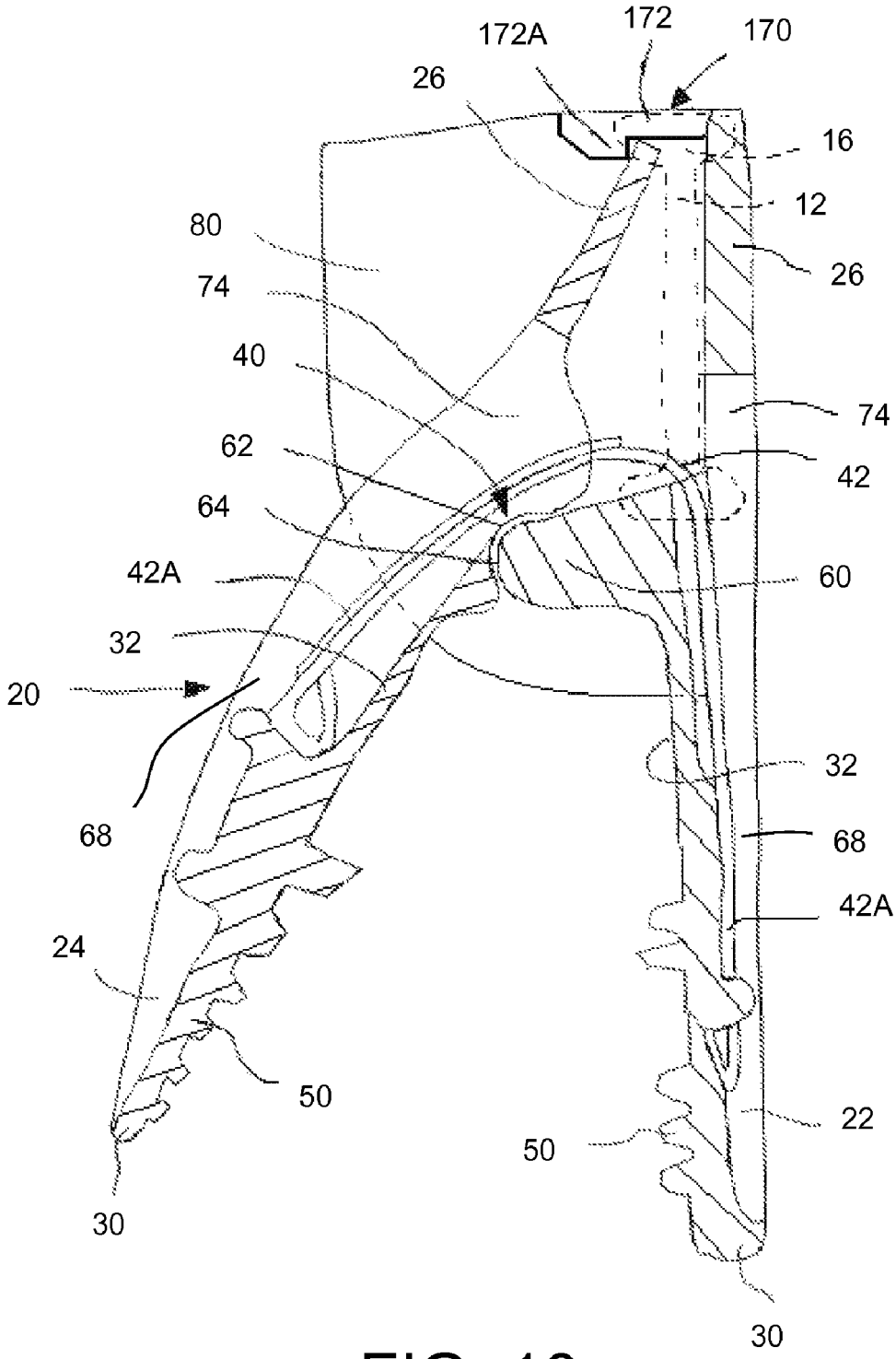
FIG. 10 is a cross sectional view of the pinch-grip in the open position taken according to one embodiment of the invention.

In another embodiment as illustrated in FIG. 10, the lock 170 includes a projection 172 extending substantially transverse from the upper edge (alternatively, a side edge) of the upper end 26 of the first component 22. The projection 172 includes a raised portion 172A that protrudes from the lower surface (alternatively, a side surface) of the projection 172 adjacent the free end. When the upper ends 26 of the components 22, 24 are brought together and the entire raised portion 172A extends beyond the outer surface of the second component 24, the projection 172 returns to its unbent extended position. As the biasing spring force 42 begins to move the lower ends 30 back toward the closed position, the inward facing side surface of the raised portion 172A engages against the outer surface of the second component 24 to lock the upper ends 26 together. The lock 170 may be disengaged in the same manner as described above with respect to FIGS. 1-8.

Figure 12:
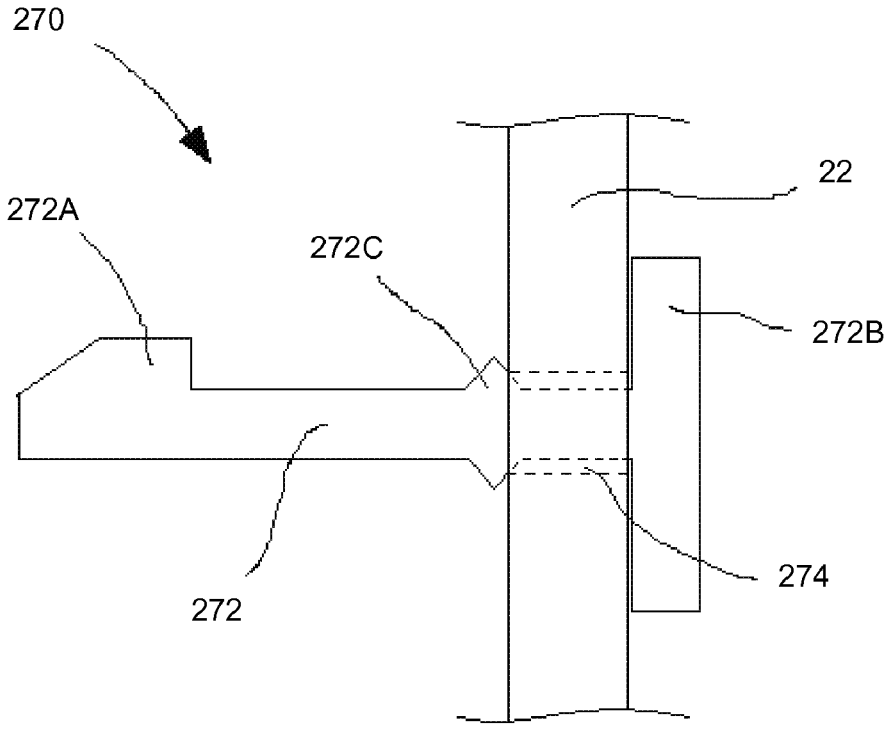
FIG. 12 is a side view of the latch insert that has been inserted into the pinch-grip hanger.

In another embodiment as illustrated in FIGS. 11-12, a lock 270 is formed as an insert that is inserted into a window 274 formed in the upper end 26 of the first component 22. The lock insert 270 includes a projection 272, a raised portion 272A that protrudes from the upper surface (alternatively, the lower surface or a side surface) of the projection 272 adjacent one end, a base portion 272B extending substantially transverse from the projection 272 at the other end, and a locking portion 272C formed intermediate the ends of the projection 272.

The lock insert 270 is inserted through the window 274 in the first component 22 so that the end of the projection 272 including the raised portion 272A extends toward the second component 24. The base portion 272B engages against the outer surface of the first component 22 and the locking portion engages the inner surface of the first component 22, thereby securing the lock insert 270 in the window 274.

Once the lock insert 270 is secured in place in the window 274 of the first component 22, the lock 270 is operated in the same manner as the embodiment described above with respect to FIGS. 1-8.

Figure 13:
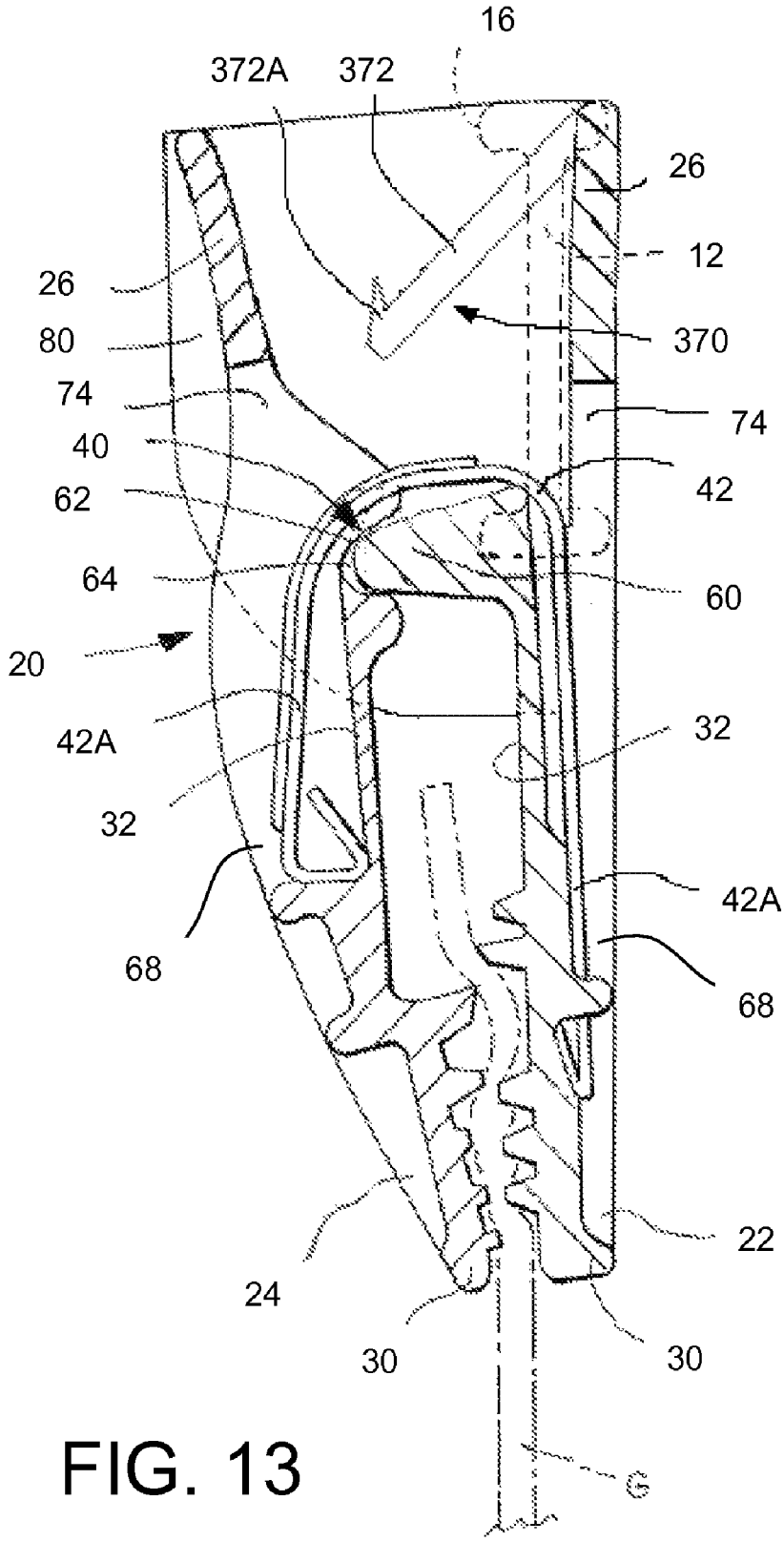
FIG. 13 is a cross sectional view of the pinch-grip in the closed position taken along the lines A-A of FIG. 2 according to one embodiment of the invention.

In another embodiment as illustrated in FIG. 13, the lock 370 includes a projection 372 extending at a decline angle from the upper edge of the upper end 26 of the first component 22. The projection 372 includes a raised portion 372A that protrudes from the upper surface of the projection 372 adjacent the free end. When the upper ends 26 of the components 22, 24 are brought together and the entire raised portion 372A through the aperture 74 in the second component 24, the projection 372 returns to its unbent extended position. As the biasing spring force 42 begins to move the lower ends 30 back toward the closed position, the inward facing side surface of the raised portion 372A engages against the outer surface of the second component 24 to lock the upper ends 26 together. The lock 370 may be disengaged in the same manner as described above with respect to the embodiment of FIGS. 1-8.

Figure 14:
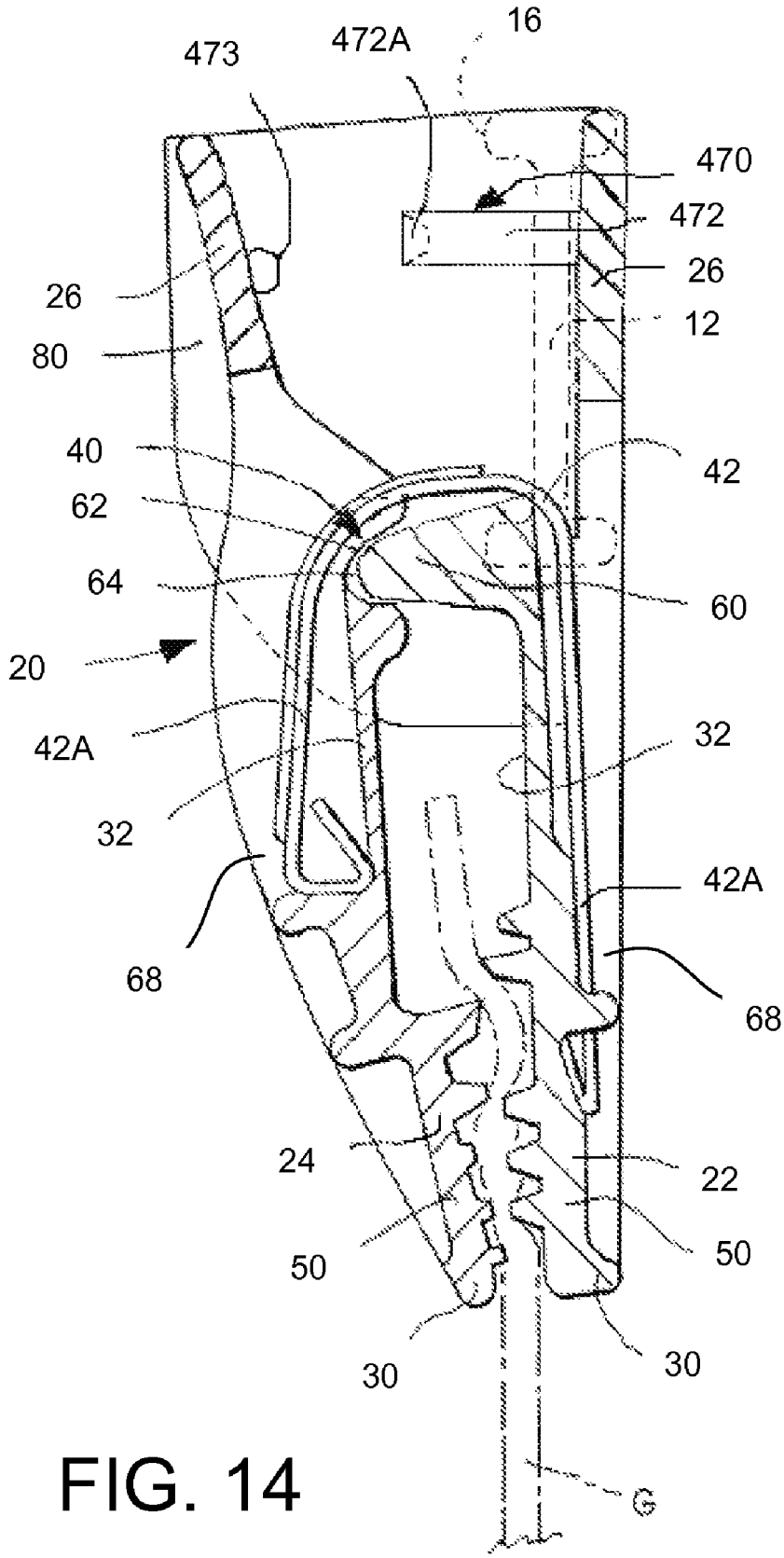
FIG. 14 is a cross sectional view of the pinch-grip in the closed position according to one embodiment of the invention.

In another embodiment as illustrated in FIG. 14, the lock 470 includes a projection 472 extending substantially transverse from the upper end 26 of the first component 22. A receiving socket 472A is defined in the free end of the projection 472. A protrusion 473 extends from the upper end 26 of the second component 24. When the upper ends 26 of the components 22, 24 are brought together, the protrusion 473 is press fit into the receiving socket 472A to lock the upper ends 26 together. The lock 470 may be disengaged by pushing the lower ends 30 together or pushing the upper ends 26 apart.

Alternatively, the receiving socket 472A may be formed in the second component 24 and a protrusion 473 may be defined at the free end of the projection 472, which may be press fit together to lock the upper ends 26 together.

Although the embodiments described above with reference to FIGS. 1-14 include a projection 72 extending from the first component 22 toward the second component 24, other embodiments may include a projection 72 that extends from the second component 24 toward the first component 22.

Figure 15:
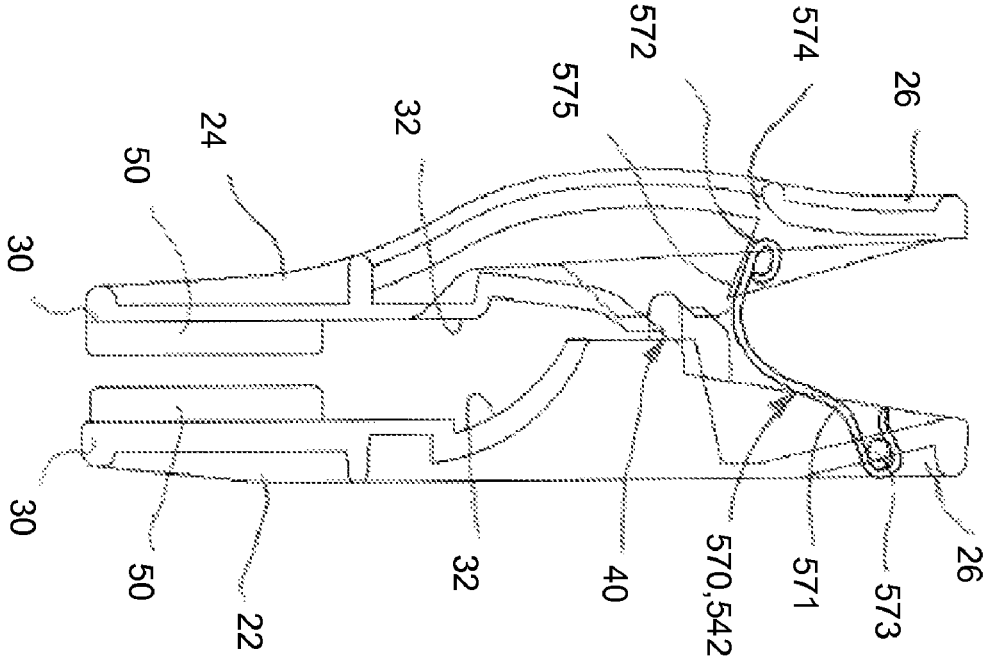
FIGS. 15-16 are cross sectional views of the pinch-grip in the closed position and open position, respectively, according to one embodiment of the invention.
Figure 16:
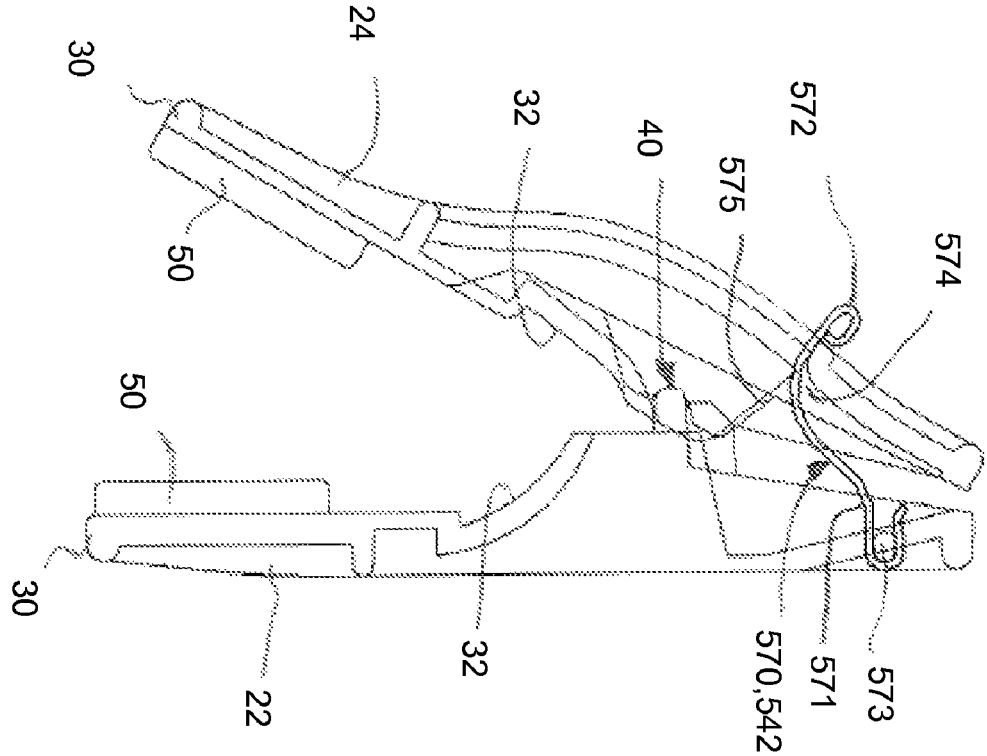

In another embodiment as illustrated in FIGS. 15-16, the releasable lock 570 and the spring force 542 are combined into a single component. A leaf spring 571 attached to the upper end 26 of the first component 22 at connection point 573. The free end 572 of the leaf spring 571 extends into and is contained within the upper end 26 of the second component 24. The free end 572 pushes against a ledge 575 in the second component to provide a spring force 542 to separate the upper ends 26 of the components 22, 24 and bias the lower ends 30 toward the closed position. When the upper ends 26 of the components 22, 24 are brought together, the free end 572 of the leaf spring 571 slides against the ledge and is resiliently bent upward as it is forced through an opening 574 in second component 24. Once the free end 572 is fully extended through the opening 574, the leaf spring 571 elastically returns to its unbent position and engages against the outer surface of the second component 24, thereby pulling together the upper ends 26 of components 22, 24. The lock 570 may be disengaged by pushing the free end 572 of the leaf spring 571 down and through the opening 574.

Figure 17:
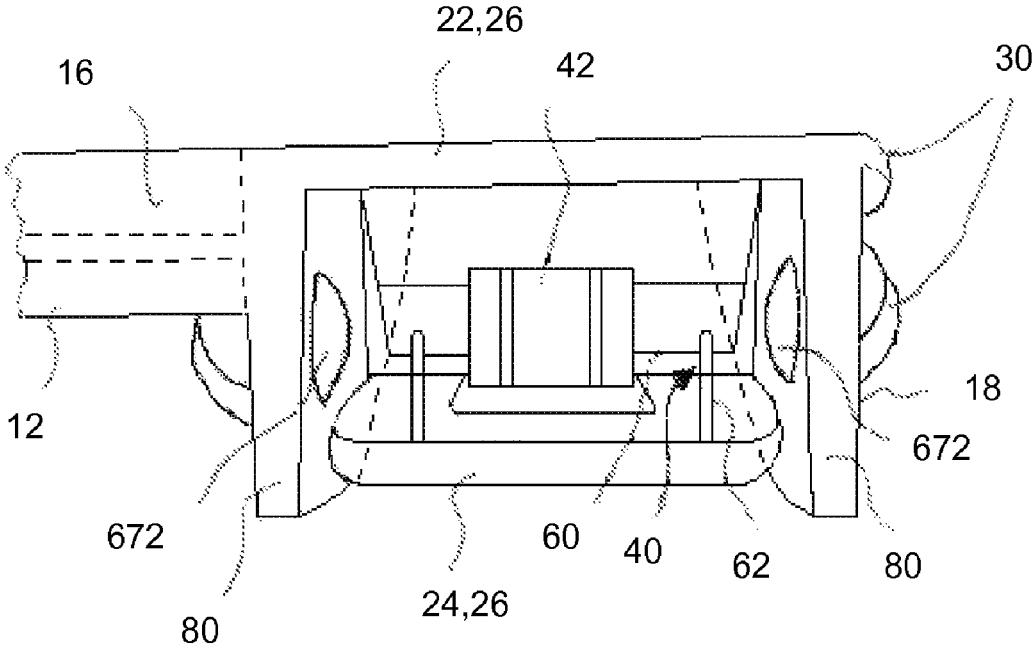
FIG. 17 is a top view of the pinch-grip in the closed position according to one embodiment of the invention.

In another embodiment as illustrated in FIG. 17, the lock includes a protrusion 672 extending from the inner surface of at least one protective projections 80 of the first component 22. For example, the protrusion 672 may be a spherical segment. When the upper ends 26 of the components 22, 24 are brought together, the upper end 26 of the second component 24 is forced past the protrusion 672 to lock the upper ends 26 together. The protrusion 672 is configured and dimensioned such that the biasing spring force 42 that is applied to the components 22, 24 cannot, on its own, push the upper end 26 of the second component 24 back past the protrusion 672. The lock may be disengaged by pushing the lower ends 30 together.

Alternatively, the protrusion 672 may be configured and dimensioned such that the biasing spring force 42 that is applied to the components 22, 24 can push the second component 24 back past the protrusion 672 after a certain amount of time (i.e., timed release).

Now that embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A hanger comprising:

at least one pinch-grip attached to the hanger for receiving an article for hanging, the pinch-grip including, first and second components extending substantially vertically from the hanger and cooperatively defining a pivot axis, each of the components including an upper end extending above the pivot axis and a lower end extending below the pivot axis, each of the components having an inner surface and an outer surface, the inner surfaces of each component being opposed surfaces facing inward toward one another and the outer surfaces of each component being surfaces facing outward away from one another, a U-shaped spring for biasing the lower ends together to a closed position and permitting separation of the lower ends to an open position by pivotal movement of at least one of the upper ends towards the other upper end, and a releasable lock having a free end extending from the first component such that the releasable lock engages the inner surface of the first component, the lock being activated to engage against the outer surface of the second component to hold the lower ends of the components in the open position.

2. The hanger of claim 1, wherein the releasable lock is automatically activated upon movement of the lower ends to the open position to lock the lower ends in the open position.

3. The hanger of claim 1, wherein when the lower ends are pivotally moved to the open position, the lock releasably locks the upper ends together.

4. The hanger of claim 1, wherein the releasable lock includes a projection extending from the first component toward the second component.

5. The hanger of claim 4, wherein the projection extends substantially transverse from the first component.

6. The hanger of claim 4, wherein the projection includes a raised portion that protrudes from at least one of an upper and lower surface of the projection adjacent the free end.

7. The hanger of claim 6, wherein when the lower ends are pivotally moved to the open position, at least the raised portion of the projection extends beyond the outer surface of the second component, and the raised portion has an inward facing surface that engages against the outer surface of the second component to lock the upper ends together.

8. The hanger of claim 6, wherein the projection extends through an opening formed in the second component.

9. The hanger of claim 1, wherein at least one projection is provided along at least one side of the upper end of the first component defining a raised pocket facing the upper end of the second component.

10. The hanger of claim 9, wherein the releasable lock includes a protrusion extending from an inner surface of the projection toward an interior of the raised pocket, and wherein when the lower ends are pivotally moved to the open position, a side edge of the protrusion engages against the outer surface of the second component to lock the upper ends together.

11. The hanger of claim 1, wherein the lock is formed integrally with the first component.

12. The hanger of claim 1, wherein the lock is activated to hold the lower ends of the components in a fully open position and an intermediate open position.

13. A hanger comprising:

at least one pinch-grip attached to the hanger for receiving an article for hanging, the pinch-grip including, first and second components extending substantially vertically from the hanger and cooperatively defining a pivot axis, each of the components including an upper end extending above the pivot axis and a lower end extending below the pivot axis, each of the components having an inner surface and an outer surface, the inner surfaces of each component being opposed surfaces facing inward toward one another and the outer surfaces of each component being surfaces facing outward away from one another, a U-shaped spring for biasing the lower ends together to a closed position and permitting separation of the lower ends to an open position by pivotal movement of at least one of the upper ends towards the other upper end, and a latch having a free end extending from the first component toward the second component such that the latch engages the inner surface of the first component, the latch engaging against the outer surface of the second component to releasably lock the upper ends together when the lower ends are pivotally moved to the open position.

14. The hanger of claim 13, wherein the latch is automatically activated upon movement of the lower ends to the open position to lock the lower ends in the open position.

15. The hanger of claim 13, wherein the latch includes a projection extending substantially transverse from the first component toward the second component.

16. The hanger of claim 15, wherein the projection includes a raised portion that protrudes from at least one of an upper and lower surface of the projection adjacent the free end.

17. The hanger of claim 16, wherein when the lower ends are pivotally moved to the open position, at least the raised portion of the projection extends beyond the outer surface of the second component, and the raised portion has an inward facing surface that engages against the outer surface of the second component to lock the upper ends together.

18. The hanger of claim 17, where the projection extends through an opening formed in the second component.

19. The hanger of claim 13, wherein the latch is formed integrally with the first component.

20. A hanger comprising:

at least one pinch-grip attached to the hanger for receiving an article for hanging, the pinch-grip including, first and second components extending substantially vertically from the hanger and cooperatively defining a pivot axis, each of the components including an upper end extending above the pivot axis and a lower end extending below the pivot axis, each of the components having an inner surface and an outer surface, the inner surfaces of each component being opposed surfaces facing inward toward one another and the outer surfaces of each component being surfaces facing outward away from one another, a U-shaped spring for biasing the lower ends together to a closed position and permitting separation of the lower ends to an open position by pivotal movement of at least one of the upper ends towards the other upper end, and a projection having a free end extending from the first component toward the second component such that the projection engages the inner surface of the first component, wherein when the lower ends are pivotally moved to the open position, the projection engages against the outer surface of the second component to releasably lock the upper ends together, thereby holding the lower ends in the open position.

21. The hanger of claim 20, where the projection extends substantially transverse from the first component.

22. The hanger of claim 20, wherein the projection includes a raised portion that protrudes from at least one of an upper and lower surface of the projection adjacent the free end.

23. The hanger of claim 22, wherein when the lower ends are pivotally moved to the open position, at least the raised portion of the projection extends beyond the outer surface of the second component, and the raised portion has an inward facing surface that engages against the outer surface of the second component to lock the upper ends together.

24. The hanger of claim 23, wherein the projection extends through an opening formed in the second component.

25. The hanger of claim 23, wherein the inward facing surface of the raised portion engages against a recess formed in the outer surface of the second component.

26. The hanger of claim 23, wherein the inward facing surface of the raised portion engages with the outer surface of the first component automatically upon movement of the lower ends to the open position.

27. The hanger of claim 22, wherein an upper, outward facing edge of the raised portion is beveled.

28. The hanger of claim 22, wherein a lower, outward facing edge of the raised portion is beveled.

29. The hanger of claim 22, wherein the projection includes a protrusion extending from a surface of the projection opposite the raised portion.

30. The hanger of claim 29, wherein the protrusion is grippable to move the projection such that the protrusion engages or disengages from the upper end of the second component.

31. The hanger of claim 20, wherein the projection is formed integrally with the first component.

32. The hanger of claim 20, wherein the projection is formed separately from the first component.

33. The hanger of claim 32, wherein the projection includes a base portion extending substantially transverse to the projection adjacent the end opposite a raised portion and a locking portion formed intermediate the ends of the projection, and wherein the projection is inserted into an opening in the first component such that the base portion engages the outer surface of the first component and the locking portion engages the inner surface of the first component to hold the projection in the opening.

34. The hanger of claim 20, wherein the projection is formed of resilient material.

35. The hanger of claim 20, wherein the projection is curved downward moving toward the free end.

36. A hanger comprising:

at least one pinch-grip attached to the hanger for receiving an article for hanging, the pinch-grip including, first and second components extending from the hanger and cooperatively defining a pivot axis, each of the components including an upper end extending above the pivot axis and a lower end extending below the pivot axis, each of the components having an inner surface and an outer surface, the inner surfaces of each component being opposed surfaces facing inward toward one another and the outer surfaces of each component being surfaces facing outward away from one another, an element providing a spring force for biasing the lower ends together to a closed position and permitting separation of the lower ends to an open position by pivotal movement of at least one of the upper ends towards the other upper end, and a releasable lock having a free end extending from an inner surface of the first component such that the releasable lock engages the inner surface of the first component, the lock being automatically activated upon movement of the lower ends to the open position to engage against the outer surface of the second component, thereby holding the lower ends of the components in the open position.

37. The hanger of claim 36, wherein the element providing the spring force and the releasable lock are a single component.

* * * * *